US012372243B2

(12) United States Patent
Ressler et al.

(10) Patent No.: US 12,372,243 B2
(45) Date of Patent: Jul. 29, 2025

(54) FIREPIT HEAT DEFLECTOR

(71) Applicant: Lamplight Farms Incorporated, Menomonee Falls, WI (US)

(72) Inventors: Kyle Ressler, West Bend, WI (US); Andrew Alan Harmeling, Milwaukee, WI (US); Daniel J. Knight, Murfreesboro, TN (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 407 days.

(21) Appl. No.: 17/745,231

(22) Filed: May 16, 2022

(65) Prior Publication Data

US 2022/0364732 A1 Nov. 17, 2022

Related U.S. Application Data

(60) Provisional application No. 63/188,877, filed on May 14, 2021.

(51) Int. Cl.

| | |
|---|---|
| ***F24C 1/16*** | (2021.01) |
| ***F24B 1/192*** | (2006.01) |
| ***F24B 1/195*** | (2006.01) |

(52) U.S. Cl.

CPC ..... *F24C 1/16* (2013.01); *F24B 1/192* (2013.01); *F24B 1/1957* (2013.01)

(58) Field of Classification Search

CPC ..... F24B 1/192; F24B 1/181; F24B 1/1957; F24C 1/16

See application file for complete search history.

(56) References Cited

U.S. PATENT DOCUMENTS

| | | | | |
|---|---|---|---|---|
| 5,094,223 | A * | 3/1992 | Gonzalez | F24B 15/005 126/41 R |
| 6,851,423 | B2 * | 2/2005 | Klemming | F24B 1/181 126/190 |
| 11,774,110 | B2 * | 10/2023 | Ressler | F24B 3/00 126/65 |
| 2004/0211410 | A1 * | 10/2004 | Kuelbs | F24B 1/192 126/519 |
| 2012/0196232 | A1 | 8/2012 | Miller | |
| 2013/0206131 | A1 * | 8/2013 | Hood | F24B 1/192 126/25 R |
| 2017/0114996 | A1 * | 4/2017 | Moneyhun | F24C 1/04 |
| 2021/0018180 | A1 * | 1/2021 | Jan | F24B 1/192 |
| 2022/0170637 | A1 * | 6/2022 | Ressler | F24B 1/192 |
| 2023/0151967 | A1 * | 5/2023 | Weilert | F24B 3/00 126/59 |

* cited by examiner

*Primary Examiner* — Alfred Basichas

(74) *Attorney, Agent, or Firm* — GableGotwals; David G. Woodral

(57) ABSTRACT

A heat deflector for a firepit includes a first fire screen, and a top assembly that reflects radiant heat. The heat deflector has an operational configuration wherein the top assembly covers the top fire screen, which is placed over a receptacle of the firepit. The heat deflector has a storage configuration wherein at least the first fire screen is stored within the receptacle.

9 Claims, 5 Drawing Sheets

FIREPIT HEAT DEFLECTOR

CROSS-REFERENCE TO RELATED CASES

This application claims the benefit of U.S. provisional patent application Ser. No. 63/188,877, filed on May 14, 2021, and incorporates such provisional application by reference into this disclosure as if fully set out at this point.

FIELD OF THE INVENTION

This disclosure relates to outdoor firepits in general and, more specifically, to a heat deflector for use with an outdoor firepit.

BACKGROUND OF THE INVENTION

Outdoor firepits have become popular and desirable for containing outdoor fires. Firepits may provide for more controlled and/or extended burning of fuels versus a completely open fire. Firepits may rely on natural wood, engineered wood logs, pelletized fuel packs, or other fuels.

Firepits may elevate the fire and at least some of the heat away from the ground surface. They may provide ash handling features. A firepit may comprise an outer wall and possibly a double wall. The outer wall or double wall may also control air flow to the fire to improve flame appearance and/or reduce smoke.

Many firepits have an upper opening through which flames appear and which allows gaseous combustion products to escape. However, in some cases, the presence of the outer wall or double wall can reduce the radiant heat felt from the fire. For some users, having at least some radiant heat is an enjoyable aspect of the outdoor fire experience.

What is needed is a device and method for addressing the above and related concerns.

SUMMARY OF THE INVENTION

The invention of the present disclosure, in one aspect thereof, comprises a heat deflector for a firepit including a first fire screen, and a top assembly that reflects radiant heat. The heat deflector has an operational configuration wherein the top assembly covers the top fire screen, which is placed over a receptacle of the firepit. The heat deflector has a storage configuration wherein at least the first fire screen is stored within the receptacle.

Some embodiments include a second fire screen interposing the first fire screen and the top assembly in the operational configuration. The second fire screen may store in the receptacle in the storage configuration. In some cases the first fire screen and the second fire screen are frustoconical and each has a narrower end joining the other in the operational configuration. The second fire screen may be inverted in the storage configuration and may receive the first fire screen in the receptacle.

The top assembly may cover the receptacle in the storage configuration. The top assembly may comprise an upper panel and a spaced apart heat reflector below the upper panel. The top assembly may further comprise a heat shield interposing the upper panel and the heat reflector. In some embodiments, the top assembly further comprises an outer ring spaced apart from the upper panel and extending laterally from below the upper panel. A handle may be affixed to the upper panel.

The invention of the present disclosure, in another aspect thereof, comprises a heat deflector for use with a fire pit having an upwardly opening receptacle opening to an internal fire engine. The heat deflector has a top assembly including an upper panel and a heat reflector spaced apart from the upper panel and facing the receptacle, and a screen extending below the top assembly to a rim surrounding the receptacle such that gases escaping the receptacle are forced out through the screen.

The heat reflector may be downwardly convex. The heat deflector may further comprise a heat shield interposing the heat reflector and the upper panel. It may include an outer ring spaced apart from the upper panel and extending laterally away from the upper panel. In some cases the screen comprises an upper screen and a lower screen. The upper screen may be affixed to the top assembly.

In some embodiments, the upper screen is frustoconical with a wider top end and a narrower bottom end and the lower screen is frustoconical with a wider bottom end and a narrower top end. In some cases, the lower screen can be inverted and fitted at least partially into the receptacle and receive at least part of the upper screen in the lower screen in the receptacle.

The invention of the present disclosure, on another aspect thereof, comprises a heat deflector kit for use with a firepit. The kit includes a top assembly having an upper panel, a lower heat reflector below the upper panel, an outer ring spaced apart from the upper panel and extending laterally outside the upper panel, and a heat shield interposing the lower heat reflector and the upper panel. A screen fits below the top assembly to fit over an opening of the firepit.

In some cases, the screen further comprises an upper screen and a lower screen, the upper screen being fitted to the top assembly. The kit may include a screen cover that fits over the lower screen in place of the upper screen and top assembly.

DETAILED DESCRIPTION OF THE PREFERRED EMBODIMENTS

The present disclosure describes various embodiments of heat deflectors for use with various firepits. In some cases, the heat deflector is convertible in that it may function solely as a spark arrestor, as a combination of a heat deflector in combination with a spark arrestor, it may be removed entirely, or it may be stowed completely within the firepit when not in use.

Various embodiments of the present disclosure are useful in a wide variety of firepits. Various firepits are described in U.S. Pat. No. 11,092,342 to Harrington, et al. (hereby incorporated by references as if set out here in its entirety), with which heat deflectors of the present disclosure may be useful. However, other firepits known in the art may find additional improvement and utility with a heat deflector of the present application.

Figure 1:
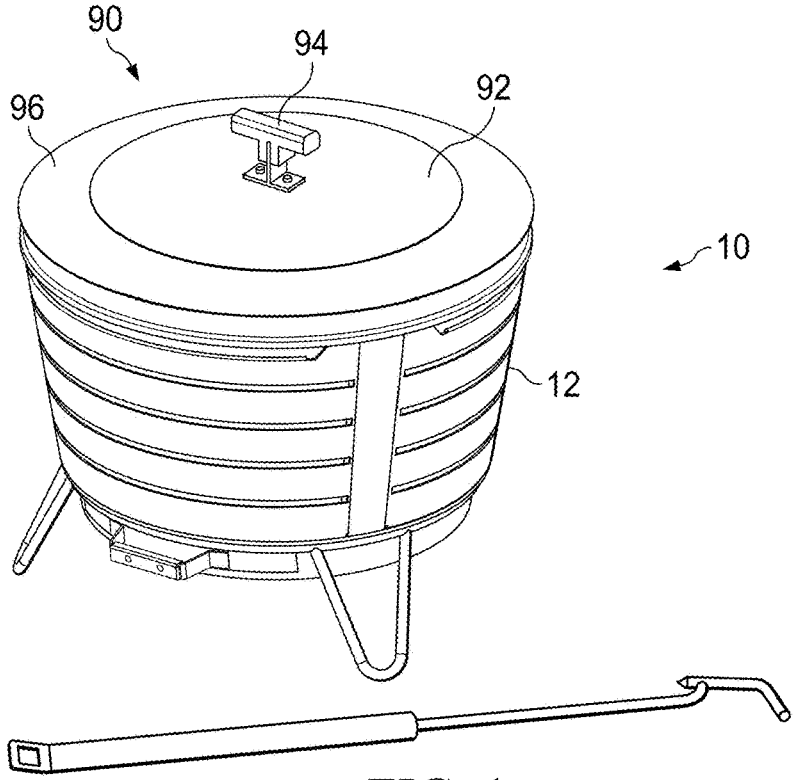
FIG. 1 is a perspective view of a firepit of the invention shown in a stowed configuration.
Figure 2:
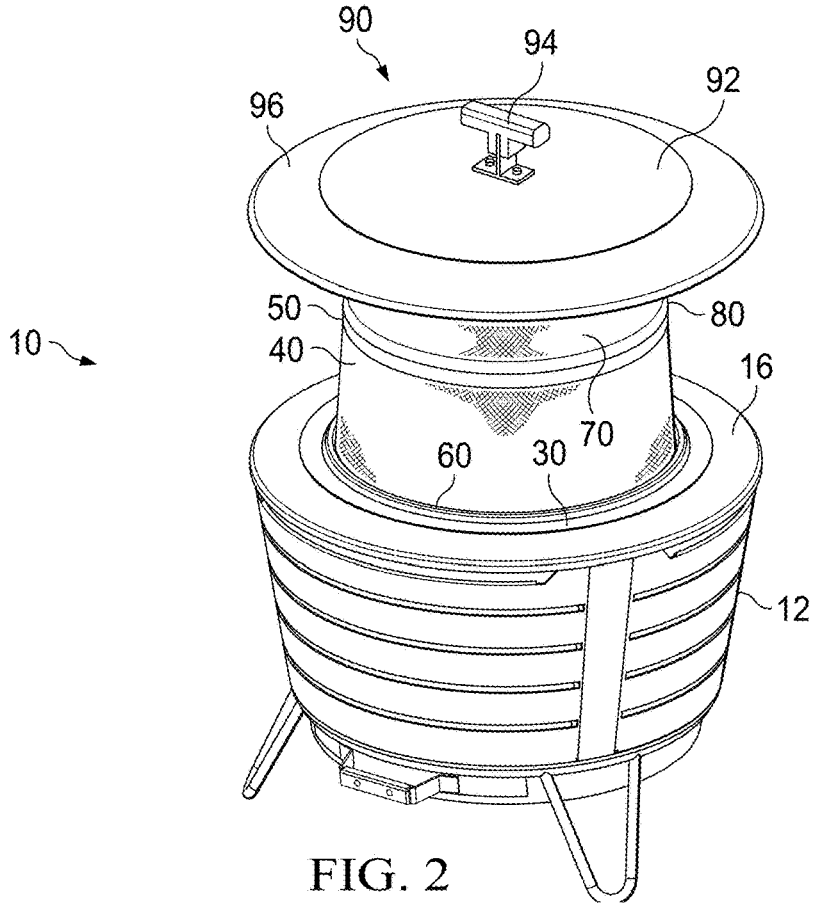
FIG. 2 is a perspective view of the firepit of FIG. 1 shown in a heat deflector configuration.
Figure 3:
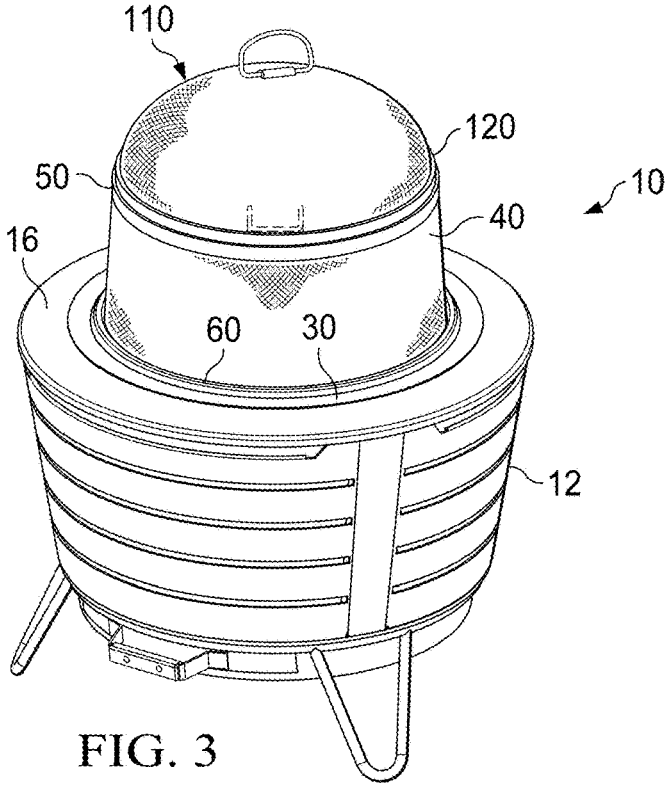
FIG. 3 is a perspective view of the firepit of FIG. 1 shown in a fire screen configuration with a fire screen cover installed.
Figure 4:
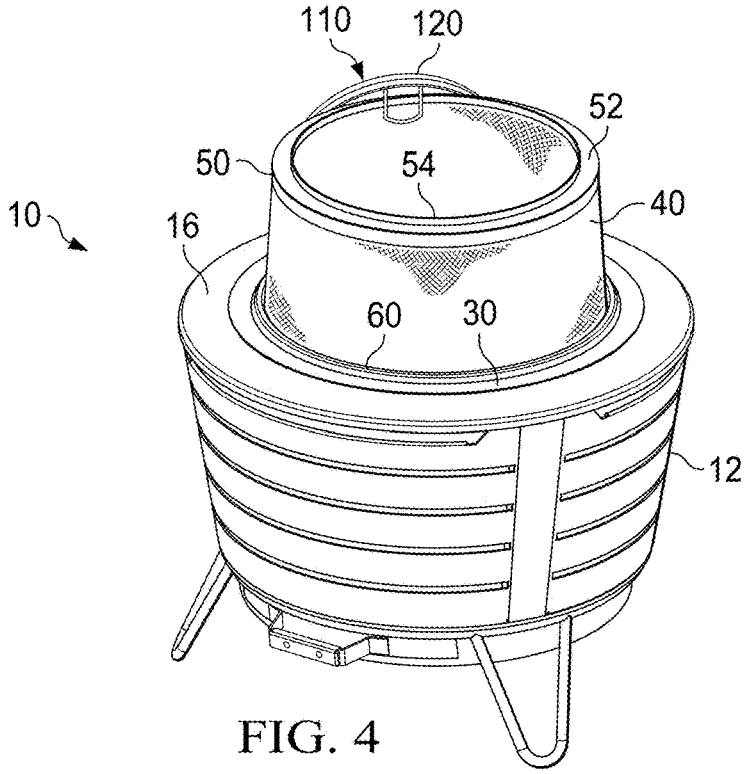
FIG. 4 is a perspective view of the firepit of FIG. 1 shown in a fire screen configuration with a fire screen cover removed.
Figure 5:
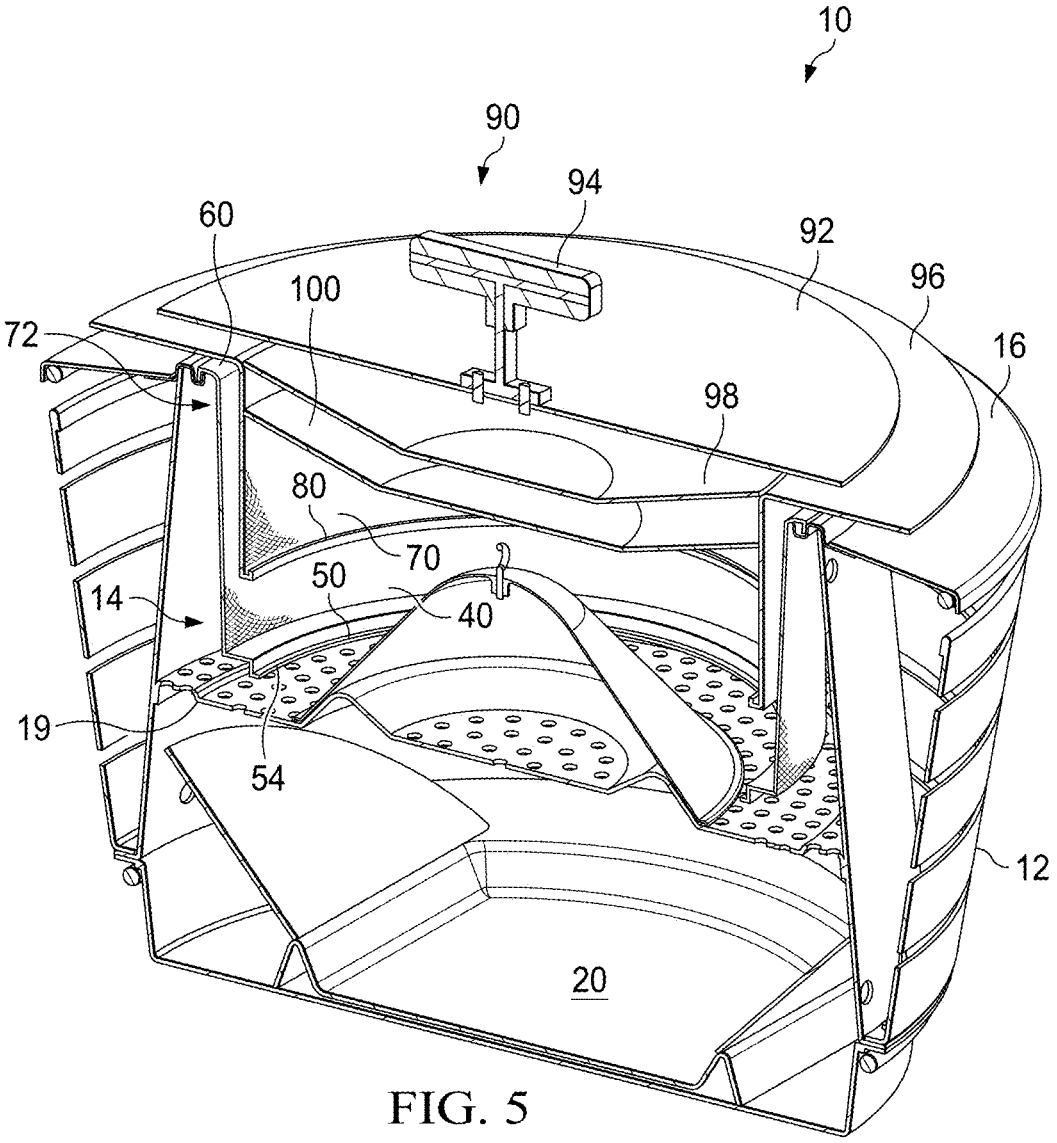
FIG. 5 is a cross-sectional perspective view of the firepit of FIG. 1.
Figure 6:
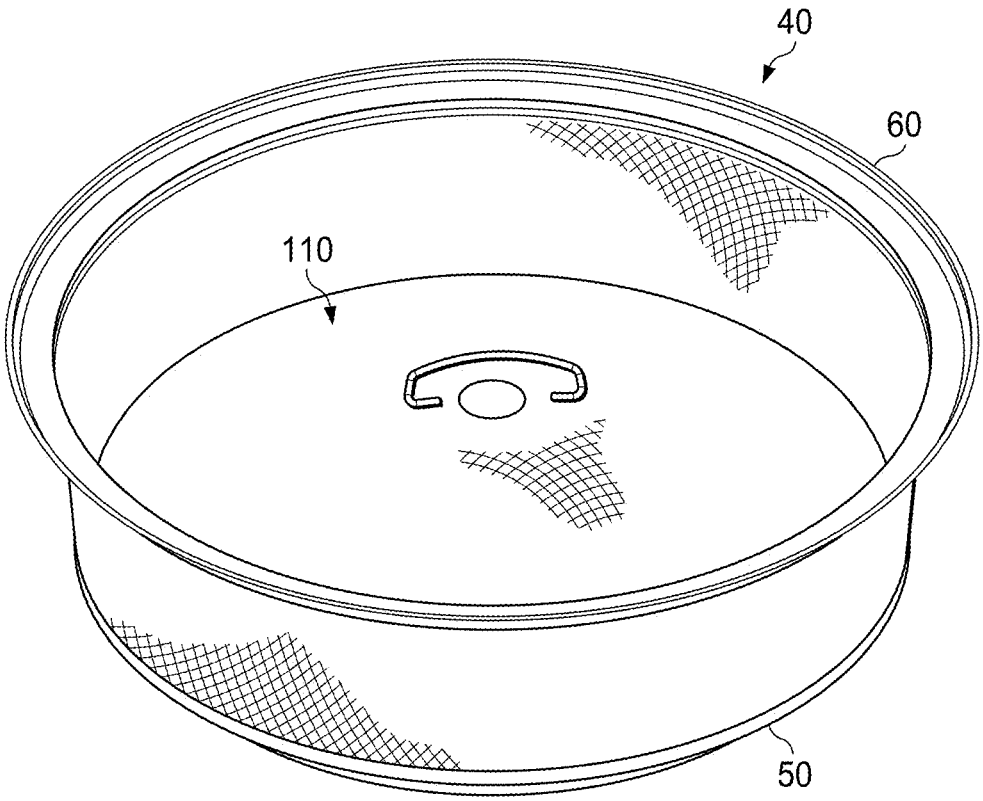
FIG. 6 is a perspective view of the fire screen cover received of FIG. 4 within an inverted lower fire screen.
Figure 7:
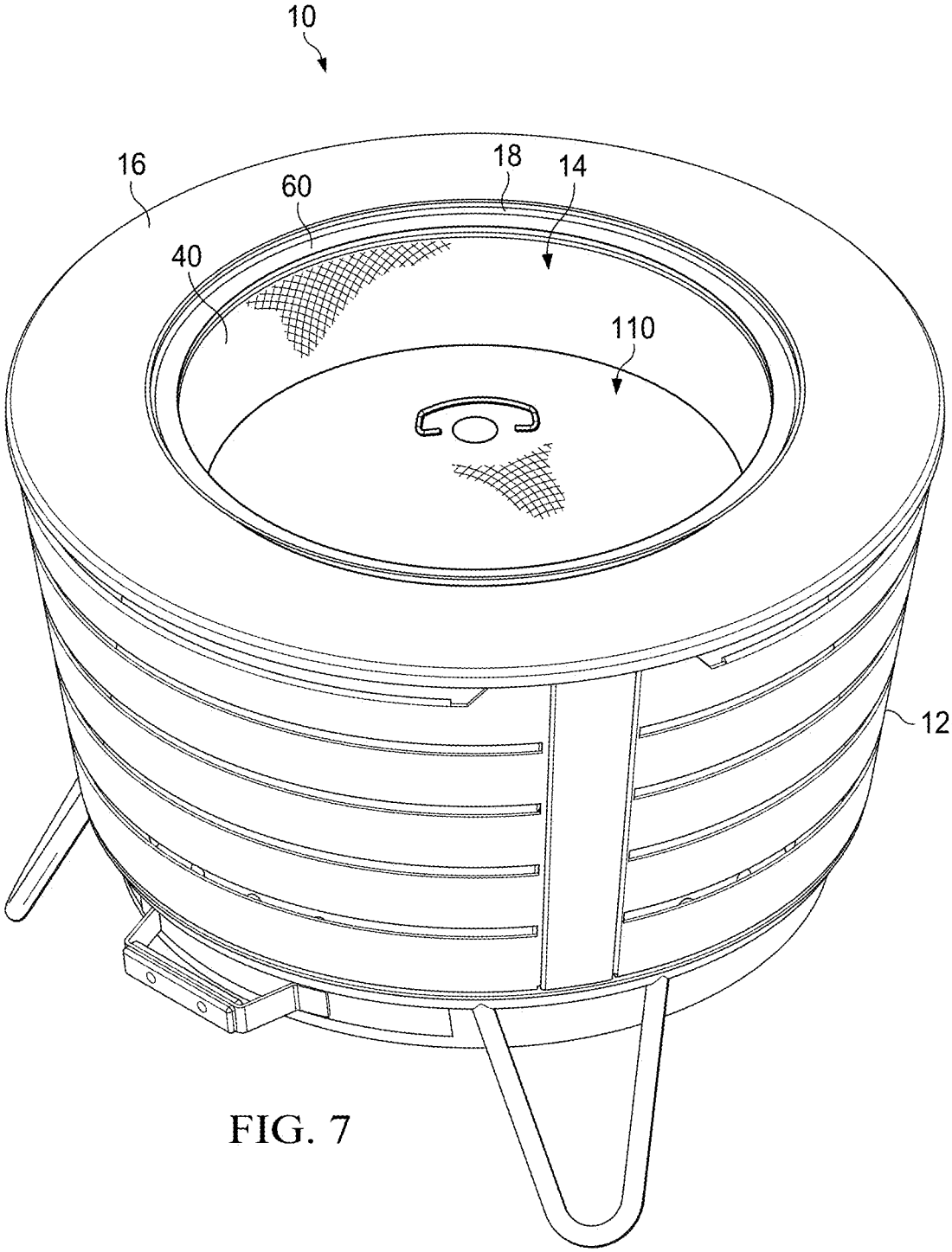
FIG. 7 is a perspective view of the fire screen cover within the inverted lower fire screen received within the firepit receptacle of the firepit of FIG. 1

With reference now to the Figures, a firepit 10 may be equipped with a heat deflector 90. FIG. 1 is a perspective view of the firepit 10 with heat deflector 90 in a stowed configuration. FIG. 2 is a perspective view of the firepit 10 with the heat deflector 90 deployed in a deflector configuration. FIG. 3 is a perspective view of the firepit 10 with the heat deflector 90 configured as a fire screen or spark arrestor only. FIG. 4 is a perspective view of the firepit 10 as shown in FIG. 3 but with a spark arrestor cover removed. FIG. 5 is a cross-sectional perspective view of the firepit 10 as shown in FIG. 1. FIG. 6 is a perspective view of a stowage configuration of spark arrestor components. FIG. 7 is a perspective view of the spark arrestor components of FIG. 6 stowed within the firepit 10.

Firepit 10 may include a firepit body 12. Firepit body 12 may define a receptacle 14. The receptacle 14 may comprise part of a combustion chamber or combustion engine of the firepit 10 and may have various air flow or air control mechanisms. The receptacle 14 may have various internal shapes and features known in the art to promote fire and/or fuel performance. The shape of the receptacle 14 is not necessarily limiting with respect to heat deflectors of the present disclosure except where relative sizes and positions of components are noted or called forth in the claims.

The firepit body 12 may have a top surface 16 that defines a firepit receptacle opening 18. The firepit receptacle opening 18 has a first width. The firepit receptacle 14 may have bottom surface 20, which has a second width. In some embodiments, the first width of firepit receptacle opening 18 is greater than the second width of bottom surface 20. In some embodiments, the bottom surface 20 comprises an ash pan. A fire grate 19 may be provided above the ash pan as a component of an internal fire or combustion engine of the fire pit 10.

Some embodiments include a support ring 30 is adjacent to or on top of top surface 16 of firepit body 12. The support ring 30 may surround or circumscribe the firepit receptacle opening 18, and may be used to locate or retain the heat deflector 90 in position on top of the fire pit 10.

The heat deflector 90 may include a lower fire screen 40 having an upper end and a lower end (upper and lower ends as shown in FIGS. 1-3). The lower fire screen 40 may have a tapered or frustoconical shape. A lower fire screen upper ring 50 is located on the upper end of lower fire screen 40. Lower fire screen upper ring 50 has a third width. Lower fire screen upper ring 50 defines support surface 52 and raised ring 54.

A lower fire screen lower ring 60 is located on the lower end of lower fire screen 40 and has a fourth width. The third width of lower fire screen upper ring 50 is less than the fourth width of lower fire screen lower ring 60.

The third width of lower fire screen upper ring 50 and fourth width of lower fire screen lower ring 60 may be less than the first width of firepit receptacle opening 18 for facilitating inversion of lower fire screen 40 and stowage of lower fire screen 40 within firepit receptacle 14 in a configuration wherein lower fire screen upper ring 50 of lower fire screen 40 is located proximate bottom surface 20 of firepit receptacle 14, as shown in FIG. 5.

As shown particularly in FIG. 2, some embodiments include an upper fire screen 70 having an upper end and a lower end. The upper fire screen 70 may have a tapered or frustoconical shape. An upper fire screen base ring 80 may be located on the lower end of upper fire screen 70. Upper fire screen base ring 80 has a fifth width that is sized to rest on support surface 52 of lower fire screen upper ring 50.

As shown particularly in FIG. 5, the heat deflector 90 may include an upper plate 92. A handle 94 may protrude from the upper plate 92. In some embodiments, the heat deflector 90 has outer ring 96 affixed to the upper plate 92. The outer ring 96 may be suspended below upper plate 92 and may extend outwardly (e.g., laterally) from upper plate 92. A heat shield 98 may be suspended below upper the plate 92. The heat shield 98 may have an outer edge between upper plate 92 and outer ring 96.

A reflector panel 100 may be suspended below the upper plate 92 and/or below the heat shield 98. The lower heat deflector 100 may have an outer edge below outer ring 96. The reflector panel 100 may have a convex or conic shape to extend downward toward the receptacle 14 when the heat deflector 90 is installed in an operational configuration (e.g., FIG. 2). The reflector panel 100 may be unperforated or substantially unperforated. Stated another way the reflector panel 100 is not a screen. It reflects radiant heat from the flame and firepit 10 downward and outward around the firepit 10. Heated combustion gases are also forced to go around the heat reflector 100 which may further promote deflection of heat from going straight up and out of the firepit 10.

The upper plate 92, the handle 94 the outer ring 96, the heat shield 98, and/or the reflector panel 100 may comprise an integrated top assembly 102. The top assembly 102 may be used as a grill cover when the heat deflector 90 is stored in the associated fire pit (e.g., FIG. 5). As shown in FIG. 2, the stop assembly 102 covers the upper fire screen 70 when the heat deflector 90 is in use. It is also possible to utilize the top assembly 102 with a single fire screen where the versatility of multiple fire screens is not needed.

Further embodiments of the heat deflector 90 may have a top assembly 102 having fewer components than those shown. In some embodiments, the heat shield 98 is not present. In further embodiments the upper plate 92 alone acts as a heat reflector (e.g., there is no separate heat shield 98 or reflector panel 100). In some embodiments the outer ring 96 is integral with the upper plate 92 or is not present. Notwithstanding the foregoing, the embodiment illustrated in FIG. 5 provides for heat deflection or reflection from the firepit 10 and the upper plate 92 is insulated from at least some heating effects by the separation from the outer ring 96, and by the reflector 100 and/or heat shield 98. The handle 94 may be further insulated from high heat by being installed on a mount that projects away from the upper plate 92.

An upper end 72 of upper fire screen 70 may be affixed or fitted onto top assembly 102, possibly circumscribing lower heat deflector 100 for placement and removal with top assembly 102, as can be seen in either a heat deflector configuration (FIG. 2) or a stowed configuration (FIG. 5).

The fifth width of upper fire screen base ring 80 may be smaller than the fourth width of the lower end of lower fire screen lower ring 60 for facilitating insertion of upper fire screen 70 within an inverted and stowed lower fire screen 40, as can best be seen in FIG. 5.

In a fire screen configuration, a fire screen cover 110 may be used as in FIGS. 3-4. The fire screen cover 110 may be dome shaped and may have a lower end. A fire screen cover base ring 120 may be on the lower end of fire screen cover 110. The fire screen cover base ring 120 has a sixth width that is sized to be received on support surface 52 of lower fire screen upper ring 50. The sixth width of fire screen cover base ring 120 may be smaller than lower fire screen lower ring 60 for facilitating insertion of fire screen cover 110 within an inverted and stowed lower fire screen 40 within firepit receptacle 14 for stowage (e.g., FIG. 5)

The top assembly 102 may be received on support ring 30 of firepit body 12 when firepit 10 is in a stowed configuration (FIGS. 1 and 5). The firepit top assembly 102 may be received on lower fire screen upper ring 50 when in the heat deflector assembly.

It should be understood that the support ring 30 may have a lip or other protrusion extending slightly into lower fire screen 40 to keep the lower fire screen 40 centered over the receptacle 14. In other embodiments, the lower fire screen 40 has a lip or protrusion for centering into the support ring 30. The lower fire screen upper ring 50 centers the upper fire screen 70 and the attached or affixed top assembly 102 on the lower fire screen 40 via the raised ring 54. In other embodiments, the upper fire screen 70 provides a protruding feature to center the upper fire screen 70 and top assembly 102 on the lower fire screen 40.

The fire pit 10 and the heat deflector 90 are shown as generally circular in a horizontal cross section, as many firepits are. However, where a heat deflector is to be used on a rectilinear or polygonal firepit, components may be adapted correspondingly. For example, the lower fire screen lower ring 60 may be adapted to a square shape, a rectangular shape, etc. where needed to fit over a receptacle opening or a support ring differing from the circular embodiments shown. Remaining components may also be adapted to conform to the general shape of a non-circular firepit to maintain symmetry and/or function.

Applicant's testing of the devices of the present disclosure, have shown that use of the top assembly 102, as opposed to use of the fire screen cover 110 or no heat deflector at all, markedly increases radiant heat transfer in the vicinity of the firepit 10. In one particular test, an increase in the temperature surrounding the firepit 10 was 11° C.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A heat deflector for use with a fire pit having an upwardly opening receptacle opening to an internal fire engine, the heat deflector comprising:

a top assembly including an upper panel and a heat reflector spaced apart from the upper panel and facing the receptacle; and a screen extending below the top assembly to a rim surrounding the receptacle such that gases escaping the receptacle are forced out through the screen;

wherein the heat reflector is downwardly convex.

2. The heat deflector of claim 1, further comprising a heat shield interposing the heat reflector and the upper panel.

3. The heat deflector of claim 1, further comprising an outer ring spaced apart from the upper panel and extending laterally away from the upper panel.

4. The heat deflector of claim 1, wherein the screen comprises an upper screen and a lower screen.

5. The heat deflector of claim 4, wherein the upper screen is affixed to the top assembly.

6. The heat deflector of claim 4 wherein:

the upper screen is frustoconical with a wider top end and a narrower bottom end and the lower screen is frustoconical with a wider bottom end and a narrower top end; and the lower screen can be inverted and fitted at least partially into the receptacle and receive at least part of the upper screen in the lower screen in the receptacle.

7. A heat deflector kit for use with a firepit comprising:

a top assembly including:

an upper panel;

a lower heat reflector below the upper panel;

an outer ring spaced apart from the upper panel and extending laterally outside the upper panel; and a heat shield interposing the lower heat reflector and the upper panel; and a screen fitting below the top assembly to fit over an opening of the firepit;

wherein the screen further comprises an upper screen and a lower screen, the upper screen being fitted to the top assembly.

8. The heat deflector kit of claim 7, further comprising a screen cover that fits over the lower screen in place of the upper screen and top assembly.

9. A heat deflector for use with a fire pit having an upwardly opening receptacle opening to an internal fire engine, the heat deflector comprising:

a top assembly including an upper panel and a heat reflector spaced apart from the upper panel and facing the receptacle;

a screen extending below the top assembly to a rim surrounding the receptacle such that gases escaping the receptacle are forced out through the screen; and a heat shield interposing the heat reflector and the upper panel.

* * * * *